US006003584A

United States Patent [19]

Weinreich

[11] Patent Number: 6,003,584

[45] Date of Patent: Dec. 21, 1999

[54] MECHANISM FOR CONSTANT BALANCE

[76] Inventor: Steve Weinreich, 14 Norton Rd., Monmouth Jct., N.J. 08852

[21] Appl. No.: 08/794,872

[22] Filed: Feb. 5, 1997

Related U.S. Application Data

[60] Provisional application No. 60/011,337, Feb. 8, 1996, and provisional application No. 60/022,314, Jul. 19, 1996.

[51] Int. Cl.[6] ..... E05F 11/00

[52] U.S. Cl. ..... 160/191; 160/170 R

[58] Field of Search ..... 160/191, 192, 160/189, 168.1 P, 168.1 R, 170 R, 171 R, 313, 314, 315, 316, 317, 318; 49/343; 74/89.15, 424.8 R

[56] References Cited

U.S. PATENT DOCUMENTS

| | | | |
|---|---|---|---|
| 926,911 | 7/1909 | Thompson | 160/170 R |
| 2,032,951 | 3/1936 | Pixley | 160/191 |
| 2,055,511 | 9/1936 | Twiss | 160/310 X |
| 2,250,106 | 7/1941 | Lorentzen | 160/170 R |
| 2,350,286 | 5/1944 | Michelman | 160/315 X |
| 2,543,711 | 2/1951 | Schultz | 160/316 X |
| 5,078,198 | 1/1992 | Tedeschi | 160/315 |
| 5,133,399 | 7/1992 | Hlller et al. | 160/170 R X |
| 5,437,324 | 8/1995 | Sternquist | 160/317 X |
| 5,531,257 | 7/1996 | Kuhar | 160/170 R X |

*Primary Examiner*—David M. Purol
*Attorney, Agent, or Firm*—Sherman and Shalloway

[57] ABSTRACT

Constant balance of a varying load, particularly a window shade or blind, is maintained by providing a lifting force, preferably from a spring, through a mediating mechanism including a variable pitch screw arrangement, such that the mechanical advantage of the mediating mechanism changes to allow the continuously decreasing spring force to apply an appropriate lifting force at all times. The variable pitch screw preferably takes the form of a twisted bar.

20 Claims, 8 Drawing Sheets

MECHANISM FOR CONSTANT BALANCE

This application claims benefit of provisional application Ser. No. 60/011,337 filed Feb. 8, 1996 also Ser. No. 60/022,314 filed Jul. 19, 1996.

BACKGROUND OF THE INVENTION

Window shades and blinds have been provided with various mechanisms to facilitate lifting. Among the roller shade mechanisms are the common spring loaded shade roller, shade rollers which are operated by chain wheels, inverted shades with rollers at the bottom, and shade rollers with internal motors. Blind mechanisms include the common venetian models and others mostly distinguished by the type of blind rather than the lifting method.

Of the above, only the common shade roller provides a means to balance the weight to be lifted and, even so, the shade must be overbalanced for proper operation of the mechanism. Furthermore, there is no arrangement to provide consistency in the balancing force versus the changing load of the shade as it is rolled up. This is apparent to anyone who has ever let go of a window shade without first setting the latching mechanism and has watched the shade abruptly snap upwards.

This invention uniquely provides a variable balancing force to track the changing load as a shade or blind is lifted. The mechanism is useful for shades, where the load decreases as the shade is lifted, and for blinds or inverted shades, where the load increases as the blind is lifted. The mechanism is also useful for other applications requiring constant balance of moving loads, particularly where space for the lifting mechanism is limited.

OUTLINE OF THE INVENTION

In the invention, constant balance is maintained by providing a lifting force, preferably from a spring, through a mediating mechanism comprising a variable pitch screw arrangement such that the mechanical advantage of the mediating mechanism changes to allow the continuously decreasing spring force to apply an appropriate lifting force at all times. Where the required lifting force can be matched by the spring constant, the pitch variability is zero and the screw pitch is constant.

The variable pitch screw preferably takes the form of a twisted bar. Methods to manufacture the bar are disclosed. Although the twisted bar is preferred, it will be obvious to one skilled in the art that there are other useful screw forms, each of which has an appropriate form for its nut or follower. For example, the screw may be a pair of (constant or variable) helixes (helices), offset 180 degrees from each other, milled into a cylindrical bar. In that case the nut preferably engages the screw with a pair of opposed pins.

Achieving constant balance allows the use of various actuators which were not previously practical. The mechanism can be overdriven to allow short throw levers, cords, or chains that, in a non-balanced system would require excessive force to operate. The bottom bar of a shade or blind can be directly pulled down or lifted by hand and will remain where it is released. The need for latches, clutches, or cleats is eliminated. Motorized embodiments can take advantage of the reduced operating force to use smaller and quieter motors. Motors for systems comprising the invention may be battery operated, particularly using solar cells (which collect light from the window being shaded) to recharge the batteries.

Friction in these systems tends to act equally in both directions and so is not usually taken into account in the design process. In some cases it may be useful to overbalance in one direction or the other so that friction is overcome for that direction of operation. This concept comes into play for, e.g., instances of direct manual operation of a shade or blind. It is easier to pull down than to lift so the system may be overbalanced to favor lifting. Thus the force to overcome friction is added primarily to the pull down direction of operation.

The invention is, however, not limited to window blind and shade mechanisms, but is intended for use in any application requiring constant balance of a predictable, variable load. Such applications include projection screens, security gates, garage doors, tailgates, and piano lids. There are also uses that can benefit from the invention even where the variable load may be only roughly predicted. Such uses include automobile hoods or awnings which may carry snow as unpredictable added loads. The invention also is intended for applications comprising only constant loads, but where physical constraints do not allow for counterweights.

In some uses (see FIG. 1) the cup or follower is the more active member, in others (see FIG. 2) the twisted bar is the more active member.

In some uses (see FIG. 1) the load may be directly connected to the mechanism, in others (see FIG. 3) an intermediate actuator may be used.

In some uses (see FIG. 1) the load decreases as it is raised, in others (see FIG. 2) the load increases as it is raised, in others the load variation may change sign as the load is raised or the load may be constant.

In some uses (see FIG. 1) the load varies non-linearly, with respect to the rotation angle between the screw and follower in others (see FIG. 2) the load varies linearly.

In some uses (see FIG. 1) there are compression springs, in others (see FIG. 2) extension springs.

It is also useful in some applications to apply the driving force to rotate one component (preferably the screw) of the screw-follower set which then balances a load connected to the translating component (preferably the follower).

DRAWINGS

FIG. 1A is an end view, taken from the left end, of the constant balance shade roller, as shown in FIG. 1.

FIG. 1B is a cross-sectional view along line B—B of FIG. 1.

FIG. 1C is a cross-sectional view along line C—C of FIG. 1.

Figures 6, 7, 8A, 8B, 9:
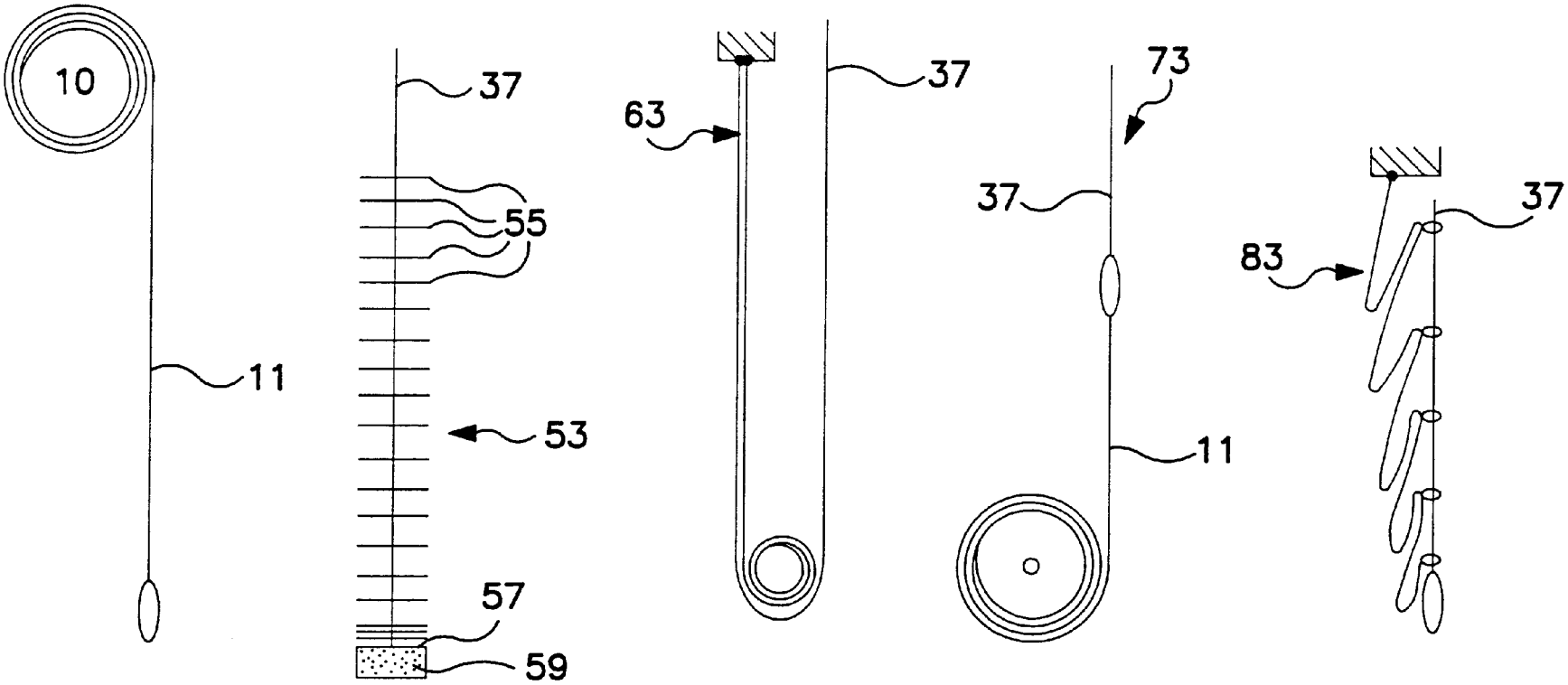
FIG. 6 shows a common roller shade, preferred in some embodiments of the invention.
FIG. 7 shows a common venetian blind, preferred in some embodiments of the invention. For simplicity, tilt cords (ladders) are not shown.

FIG. 8*a* shows one common form of inverted roller shade, preferred in some embodiments of the invention.

FIG. 8*b* shows another common form of inverted roller shade, preferred in some embodiments of the invention. For simplicity, the internal torsion spring is not indicated.

FIG. 9 shows a common roman shade used in some embodiments of the invention.

OPERATION OF THE PREFERRED EMBODIMENTS

Typical Shade Roller

Referring to the drawings, FIGS. 1, 1A, 1B and 1C show a roller [10] which is a hollow tube, preferably of metal such as aluminum, having an internal longitudinal protrusion [12]. The internal longitudinal protrusion may be formed to provide a slot on the external surface of the roller such as is known in the art to receive the top edge of the roller shade [11] as shown in FIG. 6. In one end of the roller [10] is mounted an end cap [14] holding at its center a round pin [16] which rotatably supports that end of the roller [10] in an end bracket (not shown) such as is known in the art. In the other end of the roller [10] is mounted an end cap [18] having a round hole to accomodate one end of a twisted bar [30].

A cup [20], preferably of plastic such as teflon is slip fitted into the roller [10]. The outside cylindrical wall of the cup [20] is slotted to fit over the internal longitudinal projection [12] so that the cup may translate along the interior of the roller [10], but not rotate relative to the roller [10]. The cup [20] is of sufficient length so that its face will remain parallel to the ends of the roller [10]. The face of the cup is pierced at its center by a generally rectangular hole [22].

A preferably steel, twisted rectangular bar [30] inside the roller [10] has a cylindrical segment [32] rotatably passing through the end cap [18] of the roller [10] and terminating in a rectangular segment [34]. The rectangular segment [34] rests in an end bracket (not shown) such as is known in the art and is thereby prevented from rotating.

A compression spring [40] inside the roller [10] and surrounding the twisted bar [30] fits between the end cap [18] of the roller [10] and the cup [20] with the twisted bar [30] passing through the generally rectangular hole [22] in the cup [20]. The generally rectangular hole [22] may fit rather loosely over the twisted bar [30] since these parts will always be biased in the same direction. To retain the cup [20] and to preload the spring [40] as necessary, a stop [36] is installed at the end of the twisted bar [30]. Another stop [38] is installed at the opposite extreme of cup translation.

Figure 4A:
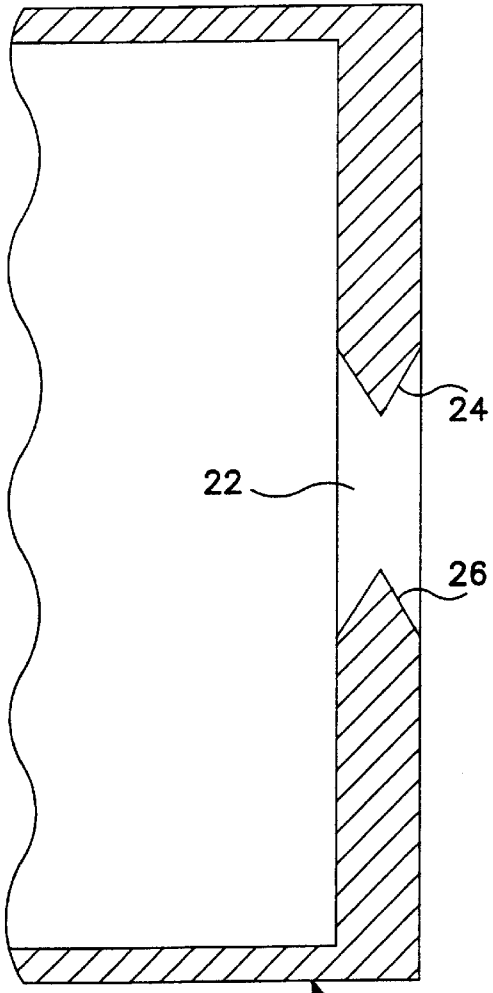
FIG. 4A is a partial cross-section view along line A—A of FIG. 4, with the twisted bar cross-sections omitted for clarity.
Figure 4:
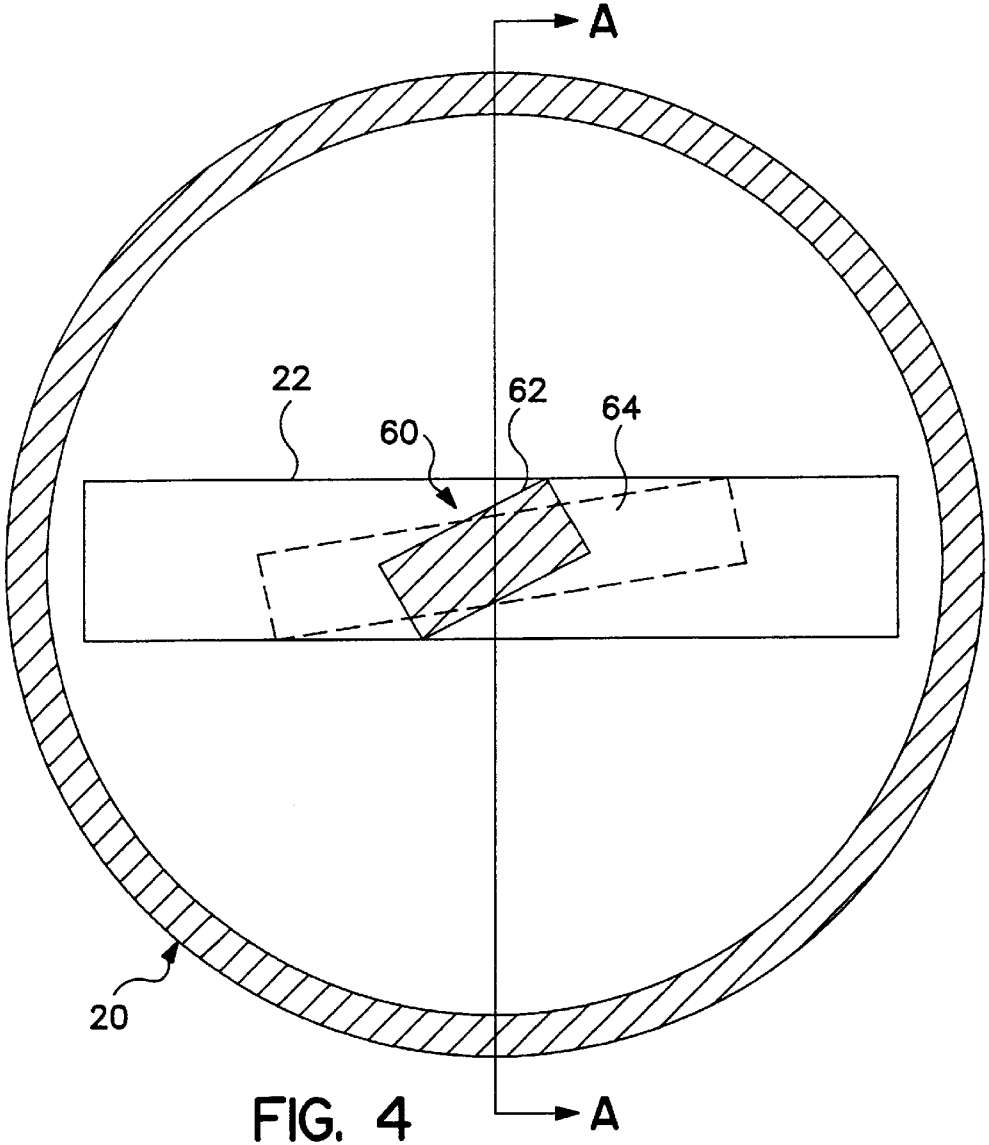
FIG. 4 is a schematic end elevation view, partially in cross-section through the follower, illustrating how different twisted bar cross sections of a twisted bar according to the invention rotate differently in a generally rectangular hole in a follower according to the invention.

The generally rectangular hole [22] in the cup [20] is formed to fit the cross section of the twisted rectangular bar [30] with relief angles 24, 26 (see FIG. 4, section through hole [22]) provided for clearance over those parts of the twisted bar [30] leading and/or following the point of contact. The relief angles must, of course, be sufficient to accomodate the most severely twisted section of the twisted bar [30].

The twisted bar [30] is made so that the lead angle at the point of contact varies from about 30 degrees to about 60 degrees. Within that range the cup [20] and the twisted bar [30] can slide against one another in either forward or back driving. In other words, if force is applied to rotate the cup [20] on the twisted bar [30], the cup and bar will translate against one another. If force is applied to translate the cup [20] on the twisted bar [30], the cup and bar will proceed to rotate against one another. Beyond approximately 30 and 60 degrees, the assembly may be bound up by excessive friction if driven the wrong way. The variably twisted bar [30] may be manufactured by ordinary machining methods or by other methods disclosed herein.

In operation, the compression spring [40] bearing against the cup [20] forces the cup [20] to translate along the twisted bar [30]. The translation in turn causes the cup [20] to rotate on the twisted bar [30]. Since the cup [20] is constrained by the internal longitudinal projection [12] from rotating in relation to the roller [10], the roller [10] also is forced to rotate. That rotation rolls up the shade [11] on the roller [10].

As the shade is raised, the weight of the unrolled portion of the shade is reduced as a function of the spiral wrapped onto the roller [10]. At the same time the moment arm increases as a function of the same spiral. This may cause the required torque to decrease faster than the linear decrease in the force exerted by the spring [40] against the cup [20]. But as the shade is raised the cup [20] translates along the twisted bar [30] toward the end having a shallower pitch angle (i.e., smaller lead angle). Thus the torque provided by the spring to the roller is caused to follow the torque requirement for constant balance.

Typical Blind Lifter

Figure 2:
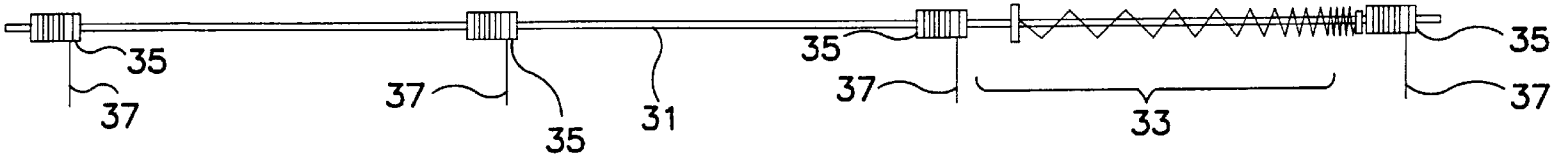
FIG. 2 is a schematic elevation view of an embodiment of a constant balance blind lifter according to this invention.
Figure 2B:
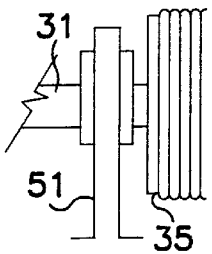
FIG. 2B is an expanded view of a portion of the winding drum and bar support at the right-hand end of FIG. 2.
Figure 2E:
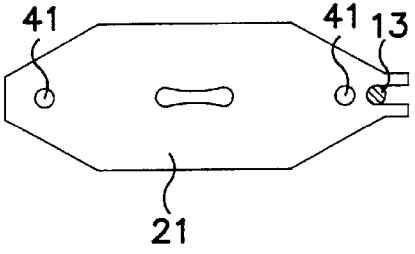
FIG. 2E is an end view, in elevation, of the follower portion of the blind lifter of FIG. 2.
Figure 2C:
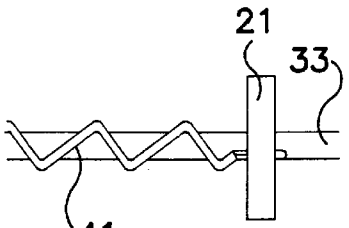
FIG. 2C is an expanded view of the follower and spring portion on the twisted bar section of the blind lifter of FIG. 2.
Figure 2D:
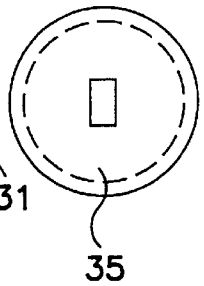
FIG. 2D is an end view, in elevation, of a winding drum portion of the blind lifter of FIG. 2.
Figure 2A:
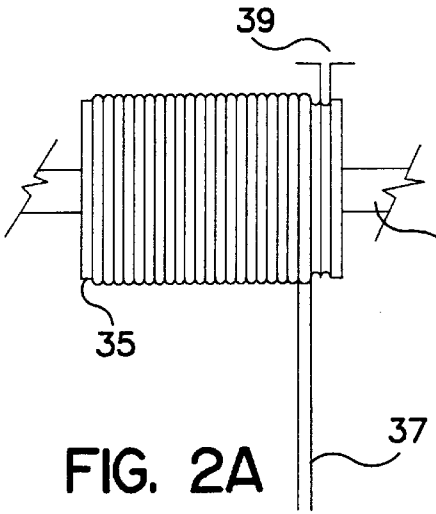
FIG. 2A is an expanded view of the winding drum and lift cord at the left-hand end of FIG. 2.
Figure 2F:
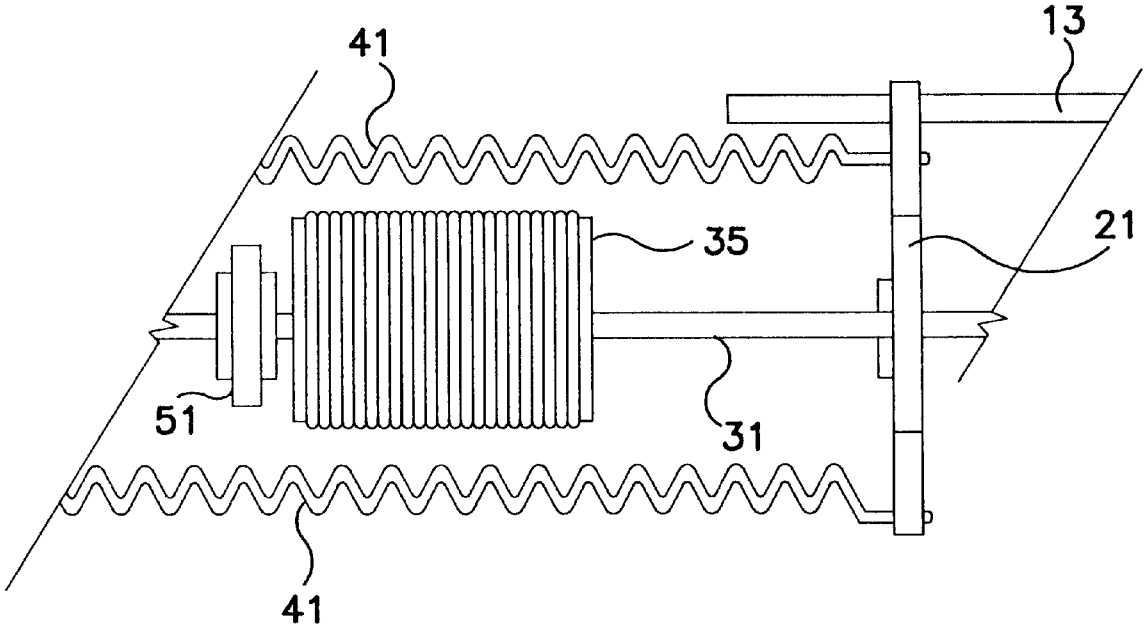
FIG. 2F is an expanded plan view of the follower, spring and winding drum portions of the blind lifter of FIG. 2.

FIG. 2 shows a long rectangular bar [31] having a twisted segment [33] and carrying helical winding drums [35]. The winding drums [35] have longitudinal rectangular holes to allow translation along, but not rotation about the bar [31]. Lift cords [37] for a window blind [53], as shown in FIG. 7, inverted roller shade [63], as shown in FIG. 8A, inverted roller shaller [73], as shown in FIG. 8B, or roman shade [83], as shown in FIG. 9, are connected to the winding drums [35]. A guide pin [39] engages each winding drum [35] (at an empty spot in the helical groove) causing the winding drum [35] to translate along the bar [31] as they rotate together. This particular arrangement is preferred because it provides a compact cross section in the surrounding window blind headrail (in which all this is mounted—not shown) and maintains the positions of the lift cords [37] as they wind up. An attractive alternative is to use one-cord-wide, deep-grooved winding drums (which need not translate).

The bar [31] is rotatably held in bar supports [51] mounted in the window blind headrail (not shown). The twisted section [33] of the bar [31] passes through a generally rectangular hole in a follower [21] which is prevented from rotating by a guide [13] along which it can translate. The follower [21] is forced along the twisted section [33] of the bar [31] by a pair of extension springs [41]. These springs [41] are as long as possible to maintain as constant a force as possible over the travel of the follower [21]. The end of springs [41] opposite the follower [21] may be secured to any fixed point in the window blind head rail.

In operation the extension springs [41] force the follower [21] to translate along the twisted section [33] of the rectangular bar [31]. The translation in turn causes the bar [31] to rotate. The winding drums [35] rotate with the bar [31] and are caused to translate along the bar [31] by the guide pins [39].

As the winding drums [35] rotate, they pull the lift cords [37] to raise, e.g., the venetian blind [53] which increases its load as successive slats [55] are picked up on the blind's bottom bar [57]. As this happens, the force of the springs [41] on the follower [21] is reduced, but the follower [21] translates toward the end of the twisted section [33] having a steeper pitch angle (i.e., larger lead angle). The force component imposing torque on the twisted section [33] is a function of the translating force applied by the springs [41] on the follower [21] and the tangent of the pitch (or lead) angle. Since the pitch (or lead) angle varies from about 30 degrees to about 60 degrees, the range of the tangents is from about 0.58 to 1.73 or a ratio of 1:3. Thus, even if the springs [41] lose one third of their length (and, thereby one third of the force they apply to the follower [21]), there is a doubling of the lifting torque (and, thereby, the lifting force) as the blind is raised.

Figure 1:
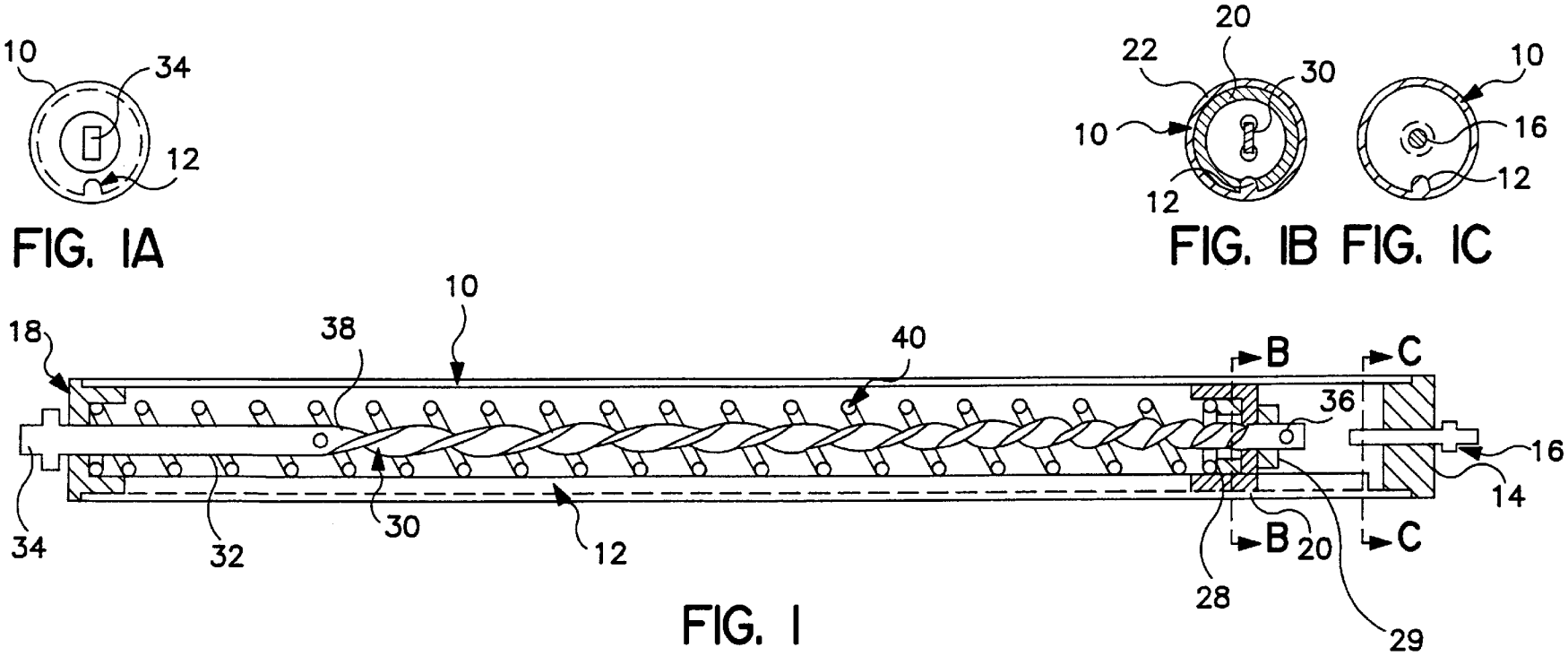
FIG. 1 is a cross-sectional view of an embodiment of a constant balance shade roller according to this invention.

An embodiment similar to the shade roller of FIG. 1 can also be used as a blind lifter, in which case the blind's lift cords are wound up on the roller. A level wind mechanism (as shown in FIG. 2 or by other ordinary means) can be incorporated.

An ordinary centrifugal clutch or centrifugal brake can be added to any of these embodiments to insure against the blind or shade dropping in case of failure of the spring or screw (or other linkage).

Added Load To Reduce Lift Ratio

The allowable ratio of the weight of the lowered blind to the weight of the raised blind is limited by the range of lifing forces possible. Where the load ratio exceeds the available lift ratio it is possible and preferred to correct the load ratio by adding additional weight [59] to the bottom bar of the blind. Thus, both the lowered and raised loads are increased, but the ratio between them is reduced. For example, if a particular blind's bottom bar weighs one pound and its slats total three pounds, the lowered load would be one pound and the raised load would be four pounds for a ratio of 1:4. Adding two pounds to the bottom bar would result in a lowered load of three pounds and a raised load of six pounds for a reduced ratio of 1:2.

An ordinary (1" slat) venetian blind bottom rail has a hollow cross section roughly 0.25 inch×0.875 inch. The cross section is about 0.219 square inches so the volume of a foot of bottom rail is about 2.63 cubic inches.

A typical four foot venetian blind bottom rail holds about 10.5 cubic inches (about 0.006 cubic feet) of dry sand weighing 0.6 pounds or concrete weighing 0.9 pounds or a one pound aluminum bar or about 2.7 pounds of iron.

Benefits Of Screw As Countershaft

Variable pitch screw as countershaft to (rather than in line with) winding drums in blind lifters:

Allows additional screw and spring design choices since number of rotations for full lift is independent of winding drum rotations. Fewer twists make screw easier to manufacture.

Provides convenient overdrive as desired for some types of actuators (such as bead chains).

Allows slimmer headrail since springs may be above or behind winding mechanism.

Avoids clearance between (longitudinally translating) winding drums as limit on length of variable pitch screw.

Eliminates design, manufacture, and assembly constraints created by variable pitch screw as segment of long shaft.

Makes possible use of a single spring on the screw axis (attached to follower by a yoke).

Toward Maximizing The Lift Ratio

It is desirable for the follower (nut) to contact the variable pitch screw as far as possible from the axis in order to minimize pressure at the contact point.

A particular screw-follower-spring combination would otherwise seem to be unaffected by the contact radius. Reducing the contact radius would seem to reduce the torque (shorter moment arm), but also increases the pitch (or lead) angle (by the screw geometry-look at a spiral staircase) thus maintaining torque.

However, provided the materials are up to the stress, the screw-follower-spring's lift ratio may be increased by changing the contact radius along the length of the screw. The contact radius should increase as the pitch (or lead) angle increases. Thus the system will tend to maintain a more consistent pitch (or lead) angle then would be possible without the variation in contact radius.

The contact radius may be controlled by various means (such as controlling an active component in the follower by means of a camming surface alongside the screw), but the preferred method is to modify the screw. This may be done by removing material which would contact the follower at points other than the preferred contact point at each position along the screw or by adding a "track" of additional material following the line of preferred contact.

It is advantageous to use the edges of the twisted bar as the "track". It is readily seen that opposite edges of the generally rectangular bar will bear against opposite edges of the nut's generally rectangular hole (see FIG. 4). The twisted bar is formed such that the generally rectangular cross section of the bar becomes wider (but usually not thicker) toward that end of the bar having the greater pitch (or lead) angle. If the twisted bar is made from a tapered blank, as described in METHOD OF MANUFACTURE FOR VARIABLE PITCH TWISTED BAR (below), the final turning operation can be omitted (or can be modified) for this purpose.

Figure 3:
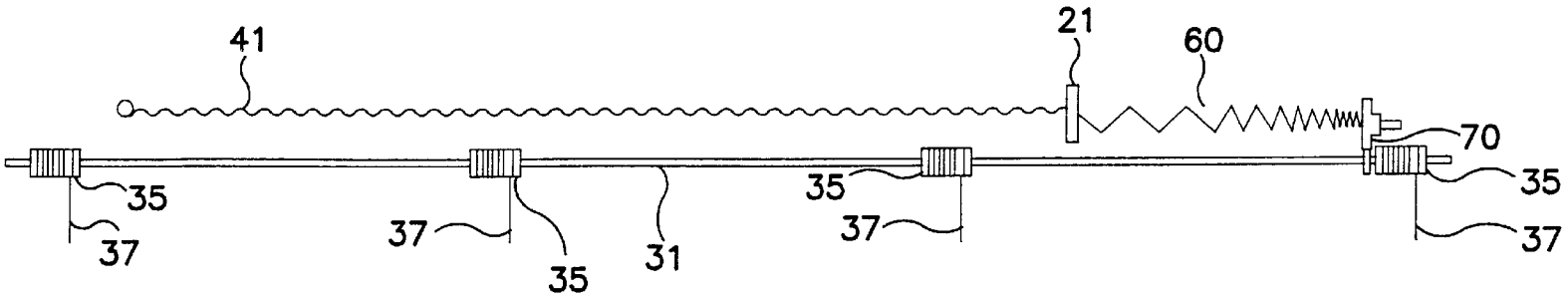
FIG. 3 is a schematic elevation view of another embodiment of a constant balance blind lifter according to the present invention incorporating a tapered twisted bar as countershaft to the winding drums.
Figure 3B:
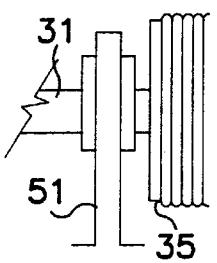
FIG. 3B is an expanded view of a portion of the winding drum and bar support at the right-hand end of FIG. 3.
Figure 3E:
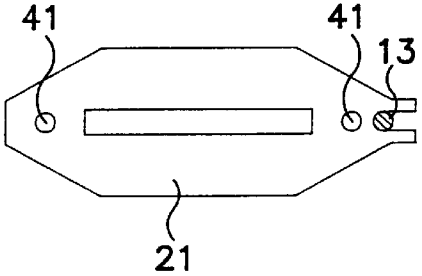
FIG. 3E is an end view, in elevation, of the follower portion of the blind lifter of FIG. 3.
Figure 3C:
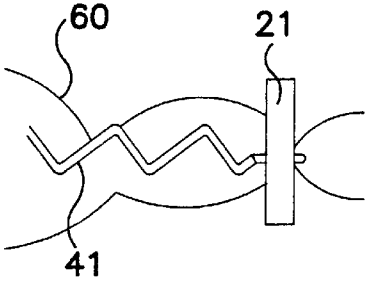
FIG. 3C is an expanded view of the follower and spring portion on the twisted bar section of the blind lifter of FIG. 3.
Figure 3D:
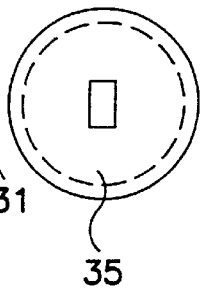
FIG. 3D is an end view, in elevation, of a winding drum portion of the blind lifter of FIG. 3.
Figure 3A:
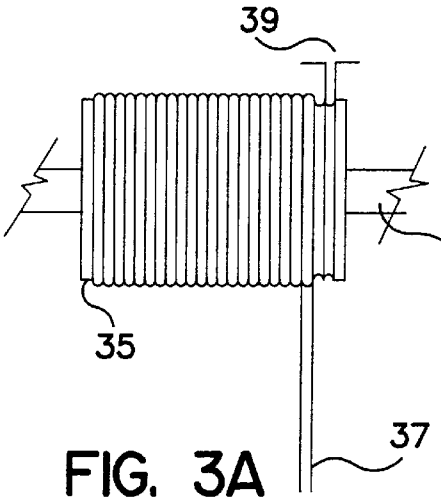
FIG. 3A is an expanded view of the winding drum and lift cord at the left-hand end of FIG. 3.
Figure 3F:
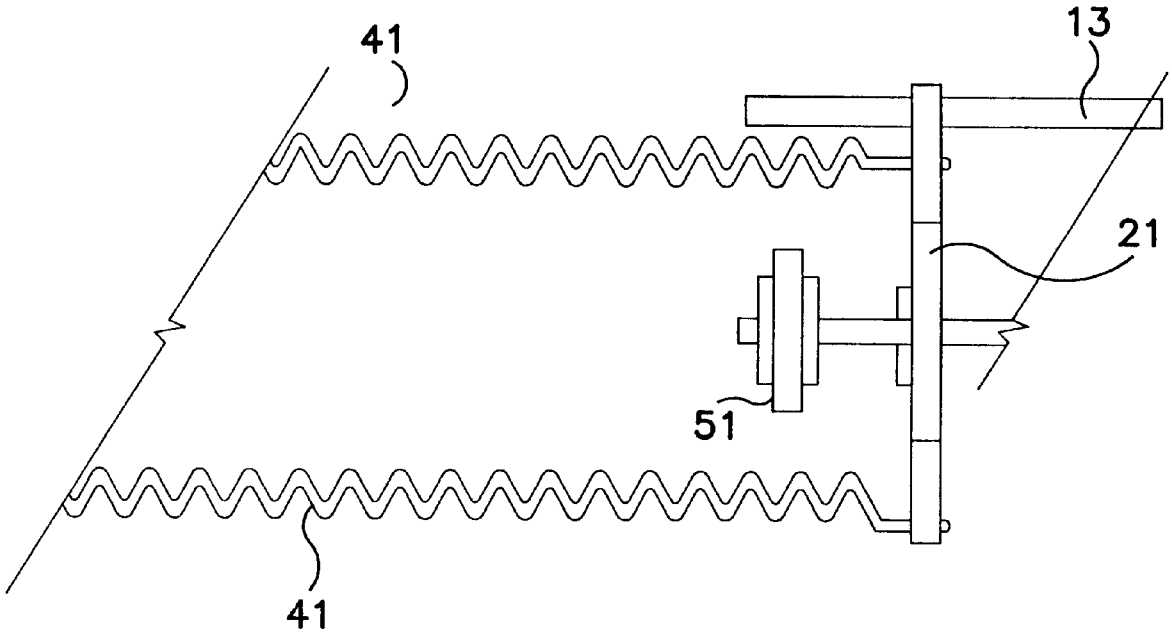
FIG. 3F is an expanded plan view of the follower and spring portions of the blind lifter of FIG. 3.

FIG. 3 shows a blind lifter comprising such a twisted bar [60] and also incorporating an overdrive gearset [70] as discussed in BENEFITS OF SCREW AS COUNTERSHAFT (above).

Where this configuration is employed, the slot in the nut must, of course, be wide enough to accomodate the wider end of the tapered bar.

The screw modification is easier to accomplish in a one way bias application such as this invention, but may also have uses in bidirectional bias applications.

The modified screw thus has limiting pitch (or lead) angles of 30 degrees at the minimum contact radius and 60 degrees at the maximum contact radius.

This also means that the greatest spring loading and the smallest pitch (or lead) angle will be at the minimum contact radius, leading to maximum stress on the parts and materials.

The screw modifications will also cause displacements of the screw's rotation angle, requiring compensating adjustments to the design. The smaller end [62] of the twisted bar [60] will rotate further in the generally rectangular hole [22] than will the larger end [64]. This can readily be seen in FIG. 4. The variation occurs because the rotation angle is dependent on the diagonal dimension of the twisted bar section. As the bar becomes narrower, the rotation angle needed to bring the edges of the bar to bear against the sides of the generally rectangular hole becomes greater.

Method of Manufacture For Variable Pitch Twisted Bar

The variable pitch twisted bar can be fabricated simply and without the use of special or uncommon equipment.

The first step of the method is preferably done on a milling machine and the second and third steps are preferably performed on a lathe. It will be apparent to one skilled in the art to use other tools without departing from the spirit and scope of the invention.

Step 1. Determine the desired cross section of the bar to be made and cut a bar such that one end is (approximately) the desired cross section and such that the bar tapers to the opposite, wider (and/or thicker) end.

Step 2. Clamp the bar at each end and rotate one clamp in relation to the other clamp such that the bar is twisted. Anneal the bar as necessary to compensate for work hardening during the process and to minimize springback. The bar will twist to a finer pitch at its narrow end and a coarser pitch at its wide end.

Step 3. Turn the twisted bar to the desired diameter or taper (if necessary).

The final screw form may be tailored by modifying the (linear or non-linear) taper and/or by other techniques such as selective annealing and intermediate clamping. It is possible to control the rate of twist independently (or largely independently) of the bar's width. A cavity (which may be tapered) can be drilled (or formed by other means) into the end of a bar to create a bar in which the density varies from end to end. The thickness of the bar can vary from end to end. The bar can be forged to vary density, hardness, and/or cross section. Other common methods to vary the hardness and/or density may also be used.

Figure 5:
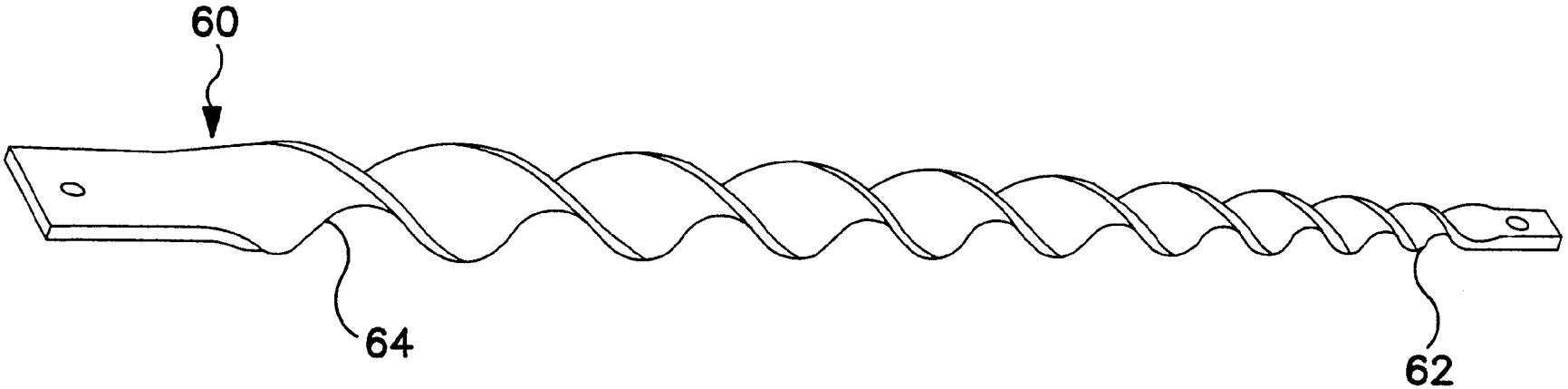
FIG. 5 is a perspective view of an embodiment of a tapered twisted bar according to the invention.

A twisted bar [60] with a smaller end [62] and a larger end [64] is shown in FIG. 5.

Use of Constant Force Springs

Constant force extension springs (usually coils of flat spring stock similar to clock springs) are known in the art. Use of these springs in place of ordinary extension springs can be advantageous where space and budget permit. Since the spring force does not change as the nut is drawn along the screw, the screw shape will be more consistent from end to end.

For some applications a weight, rather than (or in addition to) the spring, may be used to provide a constant driving force.

Another method to provide relatively constant spring force is to lengthen the ordinary extension spring (or springs) by connecting additional springs in series.

The additional springs can be connected by short lengths of cable, e.g. The cable(s) is/are passed (preferably 180°) around pulleys to fold the effective spring length into a smaller package. The longer effective length will produce a more constant force as the nut translates along the length of the screw.

Concentric springs can also be used to tailor spring characteristics and/or to minimize the size of the mechanism.

Method of Variable Pitch Screw Design

Estimating and Selecting Spring

Design of a preferred form of the variable pitch screw can be generated by balancing work-in against work-out; the work of the spring (average spring force×distance of spring end displacement) is incrementally (and, thus, wholly) balanced against the work of the shade (average weight× distance of bottom bar displacement).

It is preferred to start the design by examining the application and thereupon making a few rough calculations. As an example, the application might be a venetian blind, four feet wide with a six foot vertical drop, weighing approximately four pounds (not including its bottom bar). A first rough calculation will show that a bottom bar weighing one pound results in a lift ratio of 1:5, which seems reasonable.

A reasonable length, nine inches for this example, for the variable pitch screw is then assumed. The spring(s) must exert an average force over the nine inches (travel of the nut on the screw) such that the average force (in pounds) multiplied by the length of the screw (in inches) equals the average weight of the blind (in pounds) times the distance the bottom bar is lifted (in inches). In the example, the blind's average weight is three pounds. The lift is six feet or 72 inches. The work necessary to lift the blind is three pounds×72 inches=216 pound-inches. The average spring force must therefore be 216 pound-inches÷nine inches=24 pounds.

It is important that the spring(s) retain as much force as possible over the nine inch contraction assumed in the example. As is well known in the art, extension springs (wound with successive coils in contact) can be manufactured with an initial tension so that a slightly extended spring can exert a force substantially above the (spring rate× deflection) expected force for that slight deflection. The initial tension is typically up to 20% of a spring's maximum load (depending on spring index D/d). The initial tension is not reduced over the assumed nine inch contraction, so a high initial tension can be very useful. The force exerted by the extended spring is the initial tension+the deflection distance×the spring constant.

The deflection distance is a major factor in limiting reduction in force as the spring contracts. Disregarding the initial tension, force exerted by the spring at full deflection is reduced in proportion to the distance of contraction as a percentage of the full deflection distance. Therefore, the spring deflection should be as great as possible, making the spring rate as low as possible. The greatest spring deflection is achieved if the greatest working load is near the maximum load for the spring.

The blind in the example is four feet wide, so its headrail is four feet long. Springs attached directly to the nut can be stretched to almost the full length of the headrail. The fully extended spring length for the example can, therefore, be about 45 inches. The spring(s) should exert a force of 24 pounds when extended to the center of the nine inch long variable pitch screw (45"−0.5×9"=40.5").

Assume that the spring for the example has a typically achievable initial tension of three pounds (12.5% of the 24#). If the free length of the spring is a possible one third of the fully extended length (one half of the maximum deflection), that free length is about 45/3=15". Deflection to the center of the nine inch long variable pitch screw will be 40.5"−15"=25.5". The spring rate will be (24#−3# (the assumed initial tension))/25.5"=0.82 pounds per inch. The maximum spring force will be 24#+4.5"×0.82#/"=27.69 pounds. The spring force when deflected to the near/large end of the screw will be 24#−4.5"×0.82#/"=20.31 pounds.

The calculated spring characteristics can be used as rough parameters to select or design (by methods well known in the art) a spring or springs. This application requires a spring of about 15 inches with an initial tension of about 3 pounds and a spring rate about 0.8 pounds per inch which will produce a maximum force of about 27.5 pounds when extended (or deflected) about 30 inches. Two springs in parallel, such as shown in FIG. 2, are (by common spring calculations) required to each have about a 15 inch free length, initial tension of about 1.5 pounds, a spring rate of about 0.4 pounds per inch, and be capable of producing a maximum force of about 14 pounds (when extended by about 30 inches).

Such a spring can be designed by ordinary methods or may be found in a catalog of stock springs. There are, however, few listed stock springs 15 inches long. Nevertheless a stock spring catalog such as that available from Century Spring Corporation (printed or on disk) may be used by considering the required spring as a series of shorter springs. For this example, each of the two springs in parallel may be thought of as a series of three springs, each 5 inches long. Each of the 5 inch springs must (by common spring calculations) have an initial tension of about 1.5 pounds, a spring rate of about 1.2 pounds per inch, and produce a maximum force of about 14 pounds (when extended by about 10 inches).

Century stock number 80844 is a five inch long, 0.75 inch O.D. spring, wound from 0.063 music wire with an initial tension of one pound. The suggested maximum deflection (for long service) is 11 inches and the suggested maximum load is 15 pounds. The spring rate is 1.2 pounds per inch.

Three such springs in series will have a free length of 15". A single spring to act equivalent to the three in series will be somewhat shorter (in this case almost 3 inches shorter) because spaces needed to link the springs of the series are eliminated. Working now from the given spring characteristics, a single spring equivalent would have an initial tension of one pound. It would have a spring rate of 0.4 pounds per inch and would be capable (in long service) of producing 15 pounds of force.

Two such springs (or series) in parallel would be equivalent to a single spring with an initial tension of 2 pounds and a spring rate of 0.8 pounds per inch and would be capable of producing the required 27.5 pounds at a (calculated) 31.875" deflection.

Development of Detailed Screw Design

A detailed screw design can be generated from the characteristics of the selected spring(s) along with the already determined changing load characteristics and decisions about some mechanical details. For this example, the screw (as countershaft) will overdrive the winding drum shaft (through a pair of sprockets) in a 3:1 ratio. The winding drums will be one inch in diameter.

The screw is designed incrementally from the small (lower lead angle) end to the large (higher lead angle) end. Note that the following design development has some small errors due particularly to consideration of forces at the beginnings or ends (rather than the mid-points) of increments. These small errors can be eliminated by obvious modifications to the equations, but the inaccuracy is extremely small if a sufficient number of increments is considered. The following design of a screw for the present example will be based on 500 increments of rotation.

Since the blind of the example must be lifted 72 inches, the one inch diameter winding drums must complete 72/π=22.9 rotations. The screw will overdrive the winding drums three to one and so must complete about 7.63 rotations or 7.63×360°=2746.8°. Each of the 500 increments therefore considers a screw rotation of 2746.8÷500=5.5°.

For each 5.5° rotation of the screw, the winding drums will rotate 5.5°×3=16.5°. Each increment will therefore lift the blind 16.5°/360°×π"=0.144". This lift distance is confirmed by the simple calculation 72"/500=0.144".

The entire set of slats for the blind of the example weighs 4 pounds. The weight of 0.144 inches of slats is 4#/500=0.008#. The accumulated weight at any point in lifting the blind is the one pound bottom bar weight plus 0.008# multiplied by the number of increments to that point. The work required to lift the blind through each increment is the accumulated weight times the incremental lift distance (0.144").

Starting with the maximum spring force (27.5#), the reduction in spring force for each increment is the previous incremental pitch distance times the spring rate (0.8#/"). To determine the incremental pitch distances, which increase toward the large end of the screw, the work required for each increment (see directly above) is divided by the current spring force. The current spring force is the maximum spring force minus the current total reduction in spring force. This procedure will describe the sequence of pitch or lead distances, but does not yet describe the changing screw diameter.

The diameter of the screw (width of the twisted bar) at each point along the screw depends on the desired lead angle. A minimum and a maximum lead angle are established. A constant 45 degree lead angle would insure the smoothest operation in both forward and back driving, but would tend to produce a screw of more extreme dimensional differences from end to end. For this example the extreme angles will be 37.5 degrees and 52.5 degrees, well within the theoretical limits of 30 and 60 degrees.

It is convenient to vary the lead angle linearly from one end of the screw to the other. The lead angle increment for each increment of rotation is thus the lead angle range (maximum lead angle minus minimum lead angle) divided by the total number of increments ((52.5°−37.5°)÷500=0.03°). The desired lead angle at each increment is the minimum lead angle (37.5°) plus the lead angle increment (0.03°) multiplied by the number of increments to that point.

The screw diameter at each increment is derived from the incremental pitch distance and the desired lead angle. If each increment of rotation is 5.5 degrees, there are 360°÷5.5°=65.5 increments for each full rotation of the screw. Multiplying the incremental pitch distance by the 65.5 gives the equivalent pitch distance for a full rotation. The tangent of the lead angle is this equivalent pitch distance divided by the (unknown) circumference of the screw (as if a right triangle was wrapped around the screw). Therefore, the circumference is the equivalent pitch distance divided by the tangent of the desired lead angle. The screw diameter for the current increment is, of course, the circumference divided by pi.

Thus the incremental rotation angle, the incremental pitch distances, and the incremental diameters are established for an entire screw design to satisfy the example.

Analysis to Verify Design

In order to verify that the design satisfies the requirements of the example, the resolution of forces on the screw is examined for each increment. The force perpendicular to the screw axis is the current spring force multiplied by the tangent of the current lead angle. Screw torque is determined by multiplying this perpendicular force by the current screw radius (half the current diameter).

Torque of the winding drums is screw torque divided by the overdrive ratio.

Lift force is winding drum torque divided by the winding drum radius.

Thus the lift force produced for each increment can be compared to the lift force required for each increment.

Development of Machining Dimensions

In order to translate the theoretical screw design, developed and verified above, into a solid structure, it is necessary to first determine the desired thickness of the material for each increment. That thickness is preferably constant and for this example is chosen to be 0.0625 inches. That dimension is reasonably smaller than the minimum screw diameter (to maintain a rectangular cross section) and yet (in heat treated steel-like a screwdriver blade) is sufficient for the required torque.

The theoretical diameter for each increment is the diagonal of the cross section.

The actual (or cutting) width of the screw material at each increment is the square root of the difference of the squares of the theoretical diameter and the thickness.

Since the screw must be able to pass freely through the generally rectangular hole in the nut or follower, the generally rectangular hole must be wider than the thickness of the screw material. For this example, the width of the generally rectangular hole (or slot) is 0.078 inches.

The clearance between the screw and nut is taken up in the one way bias of the system as a relative rotation angle between the screw and nut. As the theoretical screw diameter (the diagonal of the twisted bar cross section) becomes larger, the angle of rotation between the screw and nut is slightly retarded. It is, therefore, necessary to compensate by adding an offset to each increment of rotation as the screw is machined.

Each offset angle is calculated by determining for each increment the rotation of the twisted bar within the generally rectangular hole. The bar's rotation angle is the arcsin of the quotient of the width of the generally rectangular hole divided by the theoretical screw diameter. For each successive increment, the offset is this rotation angle minus the starting rotation angle.

Each successive offset is added to each theoretical angle of rotation to determine the proper angle to machine each increment.

While the invention has been described with reference to preferred embodiments thereof, it will be appreciated by those of ordinary skill in the art that various modifications can be made to the structure and operation of the invention without departing from the spirit and scope of the invention as a whole.

I claim:

1. Apparatus to balance a first force against a second force wherein the ratio between the first force and the second force, as said first and second forces vary with respect to one another, is variable and calculatable, comprising:

a screw wherein the pitch of said screw is adapted to be proportional to said ratio and will thereby be able to maintain the first and second variable forces balanced against one another;

and a follower, engaging the thread of the screw and adapted to translate longitudinally and rotate with respect to the screw, whereby the two forces may be maintained substantially in balance when the apparatus is operationally connected to the first and second forces.

2. The apparatus of claim 1, wherein the follower defines a generally rectangular hole about the screw.

3. The apparatus of claim 1, wherein the screw comprises:

a plurality of substantially congruent threads, equally spaced about the screw whereby forces are balanced about the axis of the screw.

4. The apparatus of claim 1, wherein at least one of the forces is variable between a minimum value and a maximum value, said apparatus further comprising a constant force which is adapted to be applied to said at least one of the forces, whereby the ratio between the minimum and maximum values of that variable force is reduced, when the constant force is applied to one of the variable forces.

5. The apparatus of claim 1, also comprising:

a tube, substantially surrounding the screw.

6. The apparatus of claim 1, wherein the screw comprises a twisted bar.

7. The apparatus of claim 6, wherein the twisted bar is substantially rectangular in cross section.

8. The apparatus of claim 1, wherein the screw has a contact radius which increases as the pitch increases.

9. The apparatus of claim 1 further comprising means for producing the first force wherein the means comprises a spring.

10. The apparatus of claim 1 further comprising a load, wherein one of the two forces is produced substantially by gravity attracting said load.

11. The apparatus of claim 10, wherein the load comprises a flexible plane.

12. The apparatus of claim 10, wherein the load comprises a window covering.

13. The apparatus of claim 10, wherein the load decreases as it is lifted.

14. The apparatus of claim 10, wherein the load increases as it is lifted.

15. The apparatus of claim 10, wherein the load varies substantially linearly.

16. The apparatus of claim 10, wherein the load varies stepwise.

17. The apparatus of claim 10, further comprising:

cord winding means; and cord, connected to the load and windable upon the cord winding means, whereby the load may be drawn up.

18. Apparatus to balance a first variable force wherein the variation is substantially predictable between a minimum value and a maximum value against a second variable force wherein the variation is substantially predictable between a minimum value and a maximum value, the apparatus comprising:

a balance mediating apparatus, connected to both the first and second variable forces; and a constant force capable of being applied to one of the variable forces, whereby the ratio between the minimum and maximum values of that variable force will be reduced when the constant fore is applied to one of the variable forces.

19. In a window covering, including window shades and blinds, which includes facilitating means to facilitate lifting and lowering of the covering between fully opened and fully closed positions, the improvement comprising a mechanism for balancing the force exerted by the weight of the window covering at any particular position of travel between the fully opened and fully closed position and the force exerted thereon by said facilitating means, said mechanism comprising a variable pitch screw wherein said pitch is proportional to the ratio between the force exerted by the weight of the window covering at each particular position of travel thereof and the force exerted thereon at said each particular position by said facilitating means, and a follower, operationally connected to said facilitating means and engaging the thread of the variable pitch screw and adapted to translate longitudinally and rotate with respect to said screw.

20. The window covering according to claim 19 further comprising a head rail and wherein said facilitating mechanism comprises a spring fixed at one end thereof to a point within said head rail and at the opposite end thereof connected to said follower.

* * * * *